US009422612B2

(12) United States Patent
Kusakari et al.

(10) Patent No.: US 9,422,612 B2
(45) Date of Patent: Aug. 23, 2016

(54) ALUMINUM ALLOY WIRE

(75) Inventors: Misato Kusakari, Osaka (JP); Taichiro Nishikawa, Osaka (JP); Yoshihiro Nakai, Osaka (JP); Yoshiyuki Takaki, Osaka (JP); Yasuyuki Otsuka, Yokkaichi (JP)

(73) Assignees: SUMITOMO ELECTRIC INDUSTRIES, LTD., Osaka (JP); AUTONETWORKS TECHNOLOGIES, LTD., Mie (JP); SUMITOMO WIRING SYSTEMS, LTD., Mie (JP)

( * ) Notice: Subject to any disclaimer, the term of this patent is extended or adjusted under 35 U.S.C. 154(b) by 613 days.

(21) Appl. No.: 13/505,260

(22) PCT Filed: Oct. 27, 2010

(86) PCT No.: PCT/JP2010/069084

§ 371 (c)(1),
(2), (4) Date: Apr. 30, 2012

(87) PCT Pub. No.: WO2011/052644

PCT Pub. Date: May 5, 2011

(65) Prior Publication Data

US 2012/0217060 A1 Aug. 30, 2012

(30) Foreign Application Priority Data

Oct. 30, 2009 (JP) ..... 2009-251365

(51) Int. Cl.
*H01B 1/00* (2006.01)
*C22C 21/06* (2006.01)

(Continued)

(52) U.S. Cl.
CPC ..... *C22C 21/06* (2013.01); *C22C 21/02* (2013.01); *C22C 21/04* (2013.01); *C22F 1/04* (2013.01);

(Continued)

(58) Field of Classification Search
CPC ..... H01B 1/023
USPC ..... 174/126.1, 94 R
See application file for complete search history.

(56) References Cited

U.S. PATENT DOCUMENTS 8,278,555 B2 * 10/2012 Otsuka ..... C21D 9/60 174/126.1
2005/0100473 A1 * 5/2005 Ikuno et al. ..... 420/534
2006/0013719 A1 * 1/2006 Ichikawa et al. ..... 419/29

(Continued)

FOREIGN PATENT DOCUMENTS

JP 59-208058 11/1984
JP 60-125355 7/1985

(Continued)

*Primary Examiner* — Chau N Nguyen
(74) *Attorney, Agent, or Firm* — McDermott, Will & Emery LLP

(57) ABSTRACT

An aluminum alloy wire having excellent bending characteristics, strength, and electrically conductive characteristics, an aluminum alloy stranded wire, a covered electric wire including the above-described alloy wire or stranded wire, and a wire harness including the covered electric wire are provided. The aluminum alloy wire contains not less than 0.1% and not more than 1.5% by mass of Mg, not less than 0.03% and not more than 2.0% of Si, not less than 0.05% and not more than 0.5% of Cu, and a remainder including Al and an impurity, satisfies 0.8≤Mg/Si ratio by mass ≤3.5, has an electrical conductivity from 35% IACS to 58% IACS, a tensile strength from 150 MPa to 400 MPa, and an elongation not less than 2%. The aluminum alloy wire is manufactured through the steps of casting→rolling→wiredrawing→solution heat treatment.

9 Claims, 4 Drawing Sheets

(51) Int. Cl.

| | |
|---|---|
| ***C22C 21/02*** | (2006.01) |
| ***C22C 21/04*** | (2006.01) |
| ***C22F 1/043*** | (2006.01) |
| ***C22F 1/047*** | (2006.01) |
| ***H01B 1/02*** | (2006.01) |
| ***C22F 1/04*** | (2006.01) |

(52) U.S. Cl.
CPC ..... *C22F 1/043* (2013.01); *C22F 1/047* (2013.01); *H01B 1/023* (2013.01); *Y10T 29/49117* (2015.01)

(56) References Cited

U.S. PATENT DOCUMENTS

| | | | | |
|---|---|---|---|---|
| 2008/0175747 | A1* | 7/2008 | Kajihara et al. ..... | 420/532 |
| 2008/0196923 | A1 | 8/2008 | Susai et al. | |
| 2010/0071933 | A1 | 3/2010 | Otsuka et al. | |

FOREIGN PATENT DOCUMENTS

| | | |
|---|---|---|
| JP | 2004-134212 | 4/2004 |
| JP | 2006-253109 | 9/2006 |
| WO | WO 2008/053897 A1 | 5/2008 |

* cited by examiner

ALUMINUM ALLOY WIRE

RELATED APPLICATIONS

This application is the U.S. National Phase under 35 U.S.C. §371 of International Application No. PCT/JP2010/069084, filed on Oct. 27, 2010, which in turn claims the benefit of Japanese Application No. 2009-251365, filed on Oct. 30, 2009, the disclosures of which Applications are incorporated by reference herein.

TECHNICAL FIELD

The present invention relates to an aluminum alloy wire used as a conductor of an electric wire, an aluminum alloy stranded wire, a covered electric wire including the alloy wire or the stranded wire as a conductor, a wire harness including the covered electric wire, a method for manufacturing the aluminum alloy wire, and a method for manufacturing the covered electric wire. More particularly, the invention relates to an aluminum alloy wire having excellent bending characteristics, strength, and electrically conductive characteristics.

BACKGROUND ART

Conventionally, for a wiring structure of transportation equipment such as an automobile or aircraft, or of industrial equipment such as a robot, a form referred to as a wire harness in which a plurality of electric wires with terminals are bound has been used. A material constituting a conductor for an electric wire of such a wire harness is mostly copper having excellent electrically conductive characteristics or a copper-based material, such as copper alloy.

With the recent rapid enhancement in performance and capabilities of automobiles, and accordingly, with an increased number of various on-board electrical devices, control devices and the like, the number of electric wires used for these devices also tends to increase. Meanwhile, in recent years, weight reduction is strongly desired in order to enhance the fuel efficiency of an automobile, aircraft, or the like, for the purpose of environmental protection.

Thus, in order to achieve weight reduction in an electric wire, studies are being conducted on an aluminum electric wire that includes, as a conductor, aluminum whose specific gravity is approximately one-third that of copper. Pure aluminum, however, is inferior in bending characteristics to copper-based materials. For example, when the above-described aluminum electric wire is applied to a part that opens or closes, such as a door, it is broken at an early stage, and therefore, is difficult to apply to such a part. Japanese Patent Laying-Open No. 2004-134212 (PTL1), on the other hand, discloses an electric wire for an automobile wire harness that includes a conductor made of aluminum alloy having strength higher than that of pure aluminum.

CITATION LIST

Patent Literature

PTL 1: Japanese Patent Laying-Open No. 2004-134212

SUMMARY OF INVENTION

Technical Problem

The above-described conventional aluminum alloy electric wire, however, does not necessarily have sufficient bending characteristics. Accordingly, the development of an aluminum alloy electric wire having further improved bending characteristics is desired.

Furthermore, since a conductor for an electric wire also desirably has excellent electrically conductive characteristics and strength, there is a desire for the development of an aluminum alloy wire having excellent electrical conductivity and strength, in addition to the bending characteristics.

Accordingly, one object of the present invention is to provide an aluminum alloy wire having excellent bending characteristics, strength, and electrically conductive characteristics and suitable as a conductor for an electric wire, and to provide an aluminum alloy stranded wire.

Another object of the present invention is to provide a covered electric wire having excellent bending characteristics, strength, and electrically conductive characteristics and suitable as a wire harness, and to provide a wire harness.

A still another object of the present invention is to provide a method for manufacturing the above-described aluminum alloy wire and a method for manufacturing the above-descried covered electric wire.

Solution to Problem

The present inventors found that an aluminum alloy wire having excellent bending characteristics can be obtained by subjecting a wiredrawn material after (not necessarily immediately after) wiredrawing, which is representatively a wiredrawn material having a final wire diameter, to a solution heat treatment. It was found, in particular, that an aluminum alloy wire having high strength and electrical conductivity, while having excellent bending characteristics, can be achieved by using an aluminum alloy having a specific composition. Specifically, it was found that by performing the solution heat treatment, an added element in the aluminum alloy can be sufficiently dissolved in the base material aluminum, and strength can be improved by solid solution hardening, thus improving bending characteristics. Moreover, it was found that by performing an aging treatment after the above-described solution heat treatment, strength can be further improved by age hardening, thereby further improving bending characteristics. It was also found that by setting a content of the above-mentioned added element in a specific range, lowering of the electrical conductivity due to the dissolution of the added element can be reduced, thereby achieving an aluminum alloy wire having high electrical conductivity. Furthermore, it was found that by restricting the strength to some extent, an aluminum alloy wire having a good balance of strength and toughness can be achieved. The present invention was made based on these findings.

A method for manufacturing an aluminum alloy wire according to the present invention includes the following steps.

1. The step of forming a cast material by casting a molten aluminum alloy containing not less than 0.1% and not more than 1.5% by mass of Mg, not less than 0.03% and not more than 2.0% of Si, not less than 0.05% and not more than 0.5% of Cu, and a remainder including Al.

2. The step of forming a rolled material by rolling the above-described cast material.

3. The step of forming a wiredrawn material by wiredrawing the above-described rolled material.

4. The step of forming a heat-treated material by subjecting the above-described wiredrawn material to a solution heat treatment.

Through the steps 1 to 4 shown above, an aluminum alloy wire having an electrical conductivity not less than 35% IACS and less than 58% IACS, a tensile strength not less than 150 MPa and not more than 400 MPa, and an elongation not less than 2% is manufactured by the manufacturing method according to the present invention. The obtained aluminum alloy wire is used as a conductor.

An aluminum alloy wire according to the present invention is obtained by the manufacturing method described above. The aluminum alloy wire according to the present invention is used as a conductor and contains not less than 0.1% and not more than 1.5% by mass of Mg, not less than 0.03% and not more than 2.0% of Si, not less than 0.05% and not more than 0.5% of Cu, and a remainder including Al and an impurity. A mass ratio Mg/Si of Mg to Si satisfies $0.8 \leq Mg/Si \leq 3.5$. This aluminum alloy wire (hereinafter referred to as the "Al alloy wire") has an electrical conductivity not less than 35% IACS and less than 58% IACS, a tensile strength not less than 150 MPa and not more than 400 MPa, and an elongation not less than 2%.

Since the Al alloy wire according to the present invention is a wire that has undergone the solution heat treatment as described above, it has excellent strength and bending characteristics owing to solid solution hardening. Moreover, the Al alloy wire according to the present invention has contents of the added elements in the specific ranges, and therefore, also has excellent electrically conductive characteristics.

Furthermore, the present inventors found that when attaching a wire harness to a device or the like, an excessively high strength of a conductor may cause breakage of the conductor near a boundary between the conductor and a terminal portion. Thus, it is desired that a wire constituting a conductor for an electric wire of a wire harness be not only excellent in strength but also in toughness. The Al alloy wire according to the present invention has strength in the specific range as described above, thereby suppressing lowering of toughness due to increased strength and also having excellent toughness.

As described above, since the Al alloy wire according to the present invention is excellent in bending characteristics, strength, electrically conductive characteristics, and toughness, it sufficiently possesses characteristics desired in a wire harness, and can be suitably used as a conductor for an electric wire of a wire harness. Particularly, an electric wire having the Al alloy wire according to the present invention as a conductor is unlikely to break, even when it is disposed on a part that bends.

The present invention will hereinafter be described in detail. The contents of elements are expressed in mass %.

[Al Alloy Wire]

<Composition>

An Al alloy constituting the Al alloy wire according to the present invention is an Al—Mg—Si—Cu-based alloy containing 0.1% to 1.5% of Mg (magnesium), 0.03% to 2.0% of Si (silicon), and 0.05% to 0.5% of Cu (copper). The Al alloy wire according to the present invention contains not less than 0.1% of Mg, not less than 0.03% of Si, and not less than 0.05% of Cu, with these elements being dissolved or precipitated in Al, and thus exhibits excellent bending characteristics and strength. Although the bending characteristics and strength of the Al alloy wire improve as the Mg, Si, and Cu contents increase, the electrical conductivity and toughness decrease, and breakage of the wire tends to occur at the time of, for example, wiredrawing. Thus, Mg is set to not more than 1.5%, Si is set to not more than 2.0%, and Cu is set to not more than 0.5%.

Although Mg may greatly lower the electrical conductivity of the Al alloy wire, it is an element highly effective at improving bending characteristics and strength. Particularly, Si is contained in the specific range along with Mg, thereby effectively achieving improved strength owing to age hardening. Cu is capable of improving bending characteristics and strength without significantly lowering the electrical conductivity of the Al alloy wire. More preferred contents are not less than 0.2% and not more than 1.5% of Mg, not less than 0.1% and not more than 1.5% of Si, and not less than 0.1% and not more than 0.5% of Cu. The mass ratio Mg/Si of Mg to Si also satisfies $0.8 \leq Mg/Si \leq 3.5$. If Mg/Si is less than 0.8, the bending characteristics and strength of the Al alloy wire cannot be improved sufficiently effectively, and if Mg/Si is over 3.5, the electrical conductivity will significantly decrease. More preferably, $0.8 \leq Mg/Si \leq 3$.

Further, the above-described Al alloy may contain at least one of Fe (iron) and Cr (chromium). While Fe is capable of improving bending characteristics and strength without significantly lowering electrical conductivity, addition of excess Fe causes deterioration of workability such as in wiredrawing. Thus, a preferred Fe content is not less than 0.1% and not more than 1.0%, and particularly not less than 0.2% and not more than 0.9%. Although Cr may greatly lower electrical conductivity, it is an element highly effective at improving bending characteristics and strength. A preferred Cr content is not less than 0.01% and not more than 0.5%, and particularly not less than 0.05% and not more than 0.4%.

Furthermore, the above-described Al alloy preferably contains at least one of Ti (titanium) and B (boron). Ti and B are effective at making the crystal structure of the Al alloy finer at the time of casting. A fine crystal structure can improve strength. While the Al alloy may contain B alone, the effect of making the crystal structure finer is further improved when the Al alloy contains Ti alone, or contains both Ti and B, in particular. In order to achieve this effect of making the crystal structure finer, it is preferred that the proportion by mass of Ti be not less than 100 ppm and the proportion by mass of B be not less than 10 ppm. If, however, the proportion of Ti is over 500 ppm and the proportion of B is over 50 ppm, the above-described effect of making the crystal structure finer will become saturated or the electrical conductivity will decrease, and therefore, the proportion of Ti is preferably not more than 500 ppm and the proportion of B is not more than 50 ppm.

<Characteristics>

The Al alloy wire according to the present invention that is made of the Al alloy having the specific composition as described above and that has undergone the solution heat treatment has not only high strength but also high electrical conductivity and elongation, and satisfies the conditions of an electrical conductivity not less than 35% IACS, a tensile strength not less than 150 MPa, and an elongation not less than 2%. However, the Al alloy wire according to the present invention includes the added elements actively dissolved in the base material Al, and therefore, the extent to which the electrically conductive characteristics can be improved is limited, and the Al alloy wire has an electrical conductivity less than 58% IACS. While a tensile strength not less than 200 MPa may be more preferable, a conductor for an electric wire merely having a high strength and poor in toughness is not suitable for a wire harness, and for this reason, the Al alloy wire according to the present invention has a tensile strength not more than 400 MPa. When the tensile strength falls within the above-described range, the Al alloy wire according to the present invention can exhibit a good balance of toughness and strength.

The electrical conductivity, tensile strength, and elongation of the Al alloy wire can be varied depending on the type or the amount of the added elements, the conditions for wiredrawing, the conditions for solution heating, whether the aging treatment described further below is performed or not, and the conditions for the aging treatment. For example, when the amount of the added elements is small, the electrical conductivity and toughness tend to be improved, and when the amount of the added elements is great, the strength and bending characteristics tend to be improved. One example of the Al alloy wire according to the present invention may be an Al alloy wire satisfying the conditions of an electrical conductivity not less than 40% IACS and an elongation not less than 10%.

<Shape>

The Al alloy wire according to the present invention can have any of various wire diameters (diameters) by appropriately adjusting a drawing reduction (rate of decrease of the cross section) at the time of wiredrawing. For example, when the Al alloy wire is used as a conductor for an electric wire of an automobile wire harness, it preferably has a wire diameter not less than 0.1 mm and not more than 1.5 mm.

The Al alloy wire according to the present invention can also have any of various cross-sectional shapes depending on the die shape at the time of wiredrawing. The cross-sectional shape is representatively circular, but examples of other cross-sectional shapes include an oval shape, polygonal shapes such as rectangular and hexagonal shapes, and the like. The cross-sectional shape is not particularly limited.

[Al Alloy Stranded Wire]

A stranded wire can be formed by stranding together a plurality of the above-described Al alloy wires according to the present invention. Even in the case of wires having a small diameter, a wire (stranded wire) having high bending characteristics and strength can be obtained by stranding the wires together. The number of stranded wires is not particularly limited, and may, for example, be 7, 11, 19, or 37. Moreover, after the wires are stranded together, the Al alloy stranded wire according to the present invention may be compression-molded into a compressed wire. In this way, the wire diameter can be made smaller than that as stranded, thereby contributing to size reduction in the conductor.

[Covered Electric Wire]

The Al alloy wire according to the present invention, the Al alloy stranded wire according to the present invention, and the compressed wire described above can be suitably used as conductors for electric wires. Depending on the intended use, they may each be used as it is as a conductor, or as the covered electric wire according to the present invention that includes an insulating cover layer provided on an outer circumference of the conductor. An insulating material constituting the above-described insulating cover layer can be selected as appropriate. Examples of the insulating material may include polyvinyl chloride (PVC), non-halogen resin, material with excellent flame resistance, and the like. The thickness of the insulating cover layer may be appropriately selected in consideration of the desired insulating strength, and is not particularly limited.

[Wire Harness]

The above-described covered electric wire can be suitably used as a member constituting the wire harness according to the present invention. The wire harness according to the present invention includes the above-described covered electric wire and a terminal portion attached to an end portion of the covered electric wire. The covered electric wire is connected via this terminal portion to an object to which it is to be connected, for example, a device. This wire harness may also include a group of electric wires in which a single connector is shared by a plurality of covered electric wires each having a terminal portion attached thereto. The terminal portion may be in any of various forms such as the male type, the female type, the crimp type, the weld type, and the like, and is not particularly limited. Moreover, a plurality of covered electric wires included in the above-described wire harness may be bound together with a binding tool or the like, to thereby achieve excellent handleability. Furthermore, this wire harness can be suitably used in various fields where weight reduction is desired, particularly in an automobile in which further weight reduction is desired in order to enhance fuel economy.

[Manufacturing Method]

<Casting Step>

In the manufacturing method according to the present invention, a cast material made of an Al alloy having the above-described specific composition is formed first. In casting, any of continuous casting that uses a movable mold or a frame-shaped fixed mold and mold casting that uses a box-shaped fixed mold (hereinafter referred to as billet casting) may be used. Continuous casting, in particular, can rapidly solidify a molten metal, and therefore, can provide a cast material having a fine crystal structure. Use of such a cast material as a raw material facilitates manufacturing of an Al alloy wire having a fine crystal structure, thereby achieving improved bending characteristics and strength owing to the finer crystal. While the rate of cooling may be selected as appropriate, the cooling rate is preferably not less than 20° C./sec at a temperature in a range from 600 to 700° C. in which the molten metal is present in both solid and liquid forms. For example, a continuous casting machine having a water-cooled copper mold, a forced water-cooling mechanism, or the like may be used to achieve the rapid solidification at the cooling rate as described above.

When Ti and/or B are/is added, it is preferred that Ti and/or B be added immediately before the molten metal is poured into a mold, so as to suppress settling of Ti and/or the like in a local region to thereby manufacture a cast material in which Ti and/or the like are/is uniformly mixed, which is preferable.

<Rolling Step>

Next, the above-described cast material is (hot) rolled to form a rolled material. Particularly, when the above-described casting step and rolling step are successively performed, hot rolling can be facilitated by using the heat accumulated in the cast material, high energy efficiency is achieved, and excellent productivity of the rolled material (continuously cast and rolled material) is achieved as compared to a case where a rolled material is manufactured by rolling a cast material prepared by a batch-type casting method. Further, when the cast material is a continuously cast material, rolling is successively applied to the cast material having a fine crystal structure, thereby also providing the resulting rolled material (continuously cast and rolled material) with a fine crystal structure, which is preferable.

<Wiredrawing Step>

Next, the above-described rolled material or continuously cast and rolled material is subjected to (cold) wiredrawing to form a wiredrawn material. The drawing reduction may be selected as appropriate depending on a desired wire diameter.

In the course of wiredrawing, an intermediate heat treatment may be performed as appropriate, to remove any strain caused by the working performed before the intermediate heat treatment, thereby improving workability in wiredrawing after the intermediate heat treatment. Conditions for the intermediate heat treatment may, for example, be a heating temperature of 150 to 400° C. and a heating time not shorter than 0.5 hour. The conditions for the intermediate heat treatment may be the same as the conditions for the solution heat treatment described below.

<Wire Stranding Step>

While the resulting wiredrawn material having a final wire diameter may be used as a single wire, in one form of the manufacturing method according to the present invention, a stranded wire can be further formed through the step of preparing a plurality of the above-described wiredrawn materials and forming a stranded wire by stranding these wiredrawn materials together. Furthermore, in one form of the manufacturing method according to the present invention, a compressed wire can be formed through the step of compression-molding the above-described stranded wire to form a compressed wire having a predetermined wire diameter. In the case of forming the above-described stranded wire or compressed wire, the stranded wire or compressed wire may be subjected to the solution heat treatment described below, or the above-described stranded wire may be formed after subjecting the above-described wiredrawn material to the solution heat treatment, or after subjecting the wiredrawn material to an aging treatment when the aging treatment is performed in addition to the solution heat treatment.

<Solution Heating Step>

Next, the solution heat treatment is applied to the above-described wiredrawn material having a final wire diameter, or in the case of forming a stranded wire, to the wiredrawn materials before being stranded, or a stranded wire after stranding, or in the case of forming a compressed wire, to a stranded wire before being compressed or a compressed wire after being compressed. This solution heat treatment mainly intends to provide solid solution hardening, and is performed in order to improve bending characteristics and strength by the solid solution hardening. When a billet material is used as the cast material, the solution heat treatment may be performed both after casting and after the above-described wiredrawing. By subjecting the billet material to the solution heat treatment, the added elements are sufficiently dissolved, thus facilitating subsequent plastic working such as rolling and wiredrawing. Moreover, by further performing the solution heat treatment and aging treatment after wiredrawing, improved strength and bending properties can be achieved.

The solution heat treatment is performed under conditions that allow the above-described specific added elements to dissolve into the base material Al to form a supersaturated solid solution. For example, the wiredrawn material having a final wire diameter, the stranded wire, the compressed wire, or the like described above is heated to not lower than 450° C. and then rapidly cooled. Specifically, cooling may be performed at a cooling rate not less than 50° C./min, for example. By setting the heating temperature to not lower than 450° C., the added elements can be sufficiently dissolved into the base material Al, in the Al alloy made of the specific composition described above. Additionally, by performing rapid cooling at the high cooling rate as described above, it is possible to suppress precipitation of the elements dissolved in the base material in the cooling step. The above-mentioned cooling rate can be realized by utilizing a liquid coolant such as water or liquid nitrogen, or by forced cooling such as air blowing. Particularly, the cooling state is preferably adjusted such that the cooling rate is not less than 100° C./min.

A representative example of an atmosphere during the solution heat treatment is the ambient atmosphere. When employing other atmospheres having lower oxygen content, for example, a non-oxidizing atmosphere, it is possible to suppress the formation of an oxide film on the surface of the wire to be treated, due to the heat during the solution heat treatment. Examples of the non-oxidizing atmosphere include a vacuum atmosphere (reduced-pressure atmosphere), an inert gas atmosphere such as nitrogen ($N_2$) or argon (Ar), a hydrogen-containing gas (for example, hydrogen ($H_2$) only or a mixed gas of hydrogen ($H_2$) and an inert gas such as $N_2$, Ar, or helium (He)), and a reducing gas atmosphere such as a carbon dioxide-containing gas (for example, a mixed gas of carbon monoxide (CO) and carbon dioxide ($CO_2$)).

Further, a continuous heat treatment or a batch-type heat treatment can be used in the solution heat treatment.

(Batch-Type Heat Treatment)

The batch-type heat treatment is a treatment method in which heating is performed with an object to be heated being enclosed in a heating vessel (atmosphere furnace, such as a box-shaped furnace). Although the throughput per treatment is limited, the treatment method can readily control the temperature and manage the heating state of the whole object to be heated. In the batch-type heat treatment, the temperature of the atmosphere in the heating vessel may be set such that the object to be heated is heated to a predetermined temperature.

(Continuous Heat Treatment)

The continuous heat treatment is a treatment method in which an object to be heated is continuously heated by continuously feeding objects into a heating vessel. The treatment method has, for example, the following advantages: 1. the object can be continuously heated, and thus, excellent operability is achieved; and 2. the wire to be heated can be uniformly heated in the longitudinal direction, thus suppressing variations in characteristics in the longitudinal direction of the wire. Particularly, the continuous heat treatment can be suitably used where the solution heat treatment is applied to a long wire as used for a conductor for an electric wire.

Examples of the above-described continuous heat treatment may include a direct electrical heating method in which an object to be heated is heated by resistance heating (continuous electrical heat treatment), an indirect electrical heating method in which an object to be heated is heated by high-frequency electromagnetic induction (continuous heat treatment by high-frequency induction), and a furnace method in which an object to be heated is introduced into a heating vessel (pipe furnace) set to a heating atmosphere and the object is heated by heat transfer.

In the above-described continuous heat treatment, for example, a sample is subjected to the solution heat treatment by appropriately varying a variety of control parameters, and characteristics (here, tensile strength, electrical conductivity, and elongation) of the sample and a temperature of the sample (measured, for example, by using a non-contact type temperature measurement device) at that time are measured. Then, correlation data between the parameter values and measured data is created in advance. Based on this correlation data, it is possible to adjust the above-mentioned control parameters so as to yield a solution-heat-treated material having desired characteristics (here, tensile strength: 150 MPa to 400 MPa, electrical conductivity: 35% IACS to 58%

IACS, and elongation: not less than 2%), and to control the temperature, thereby easily performing the solution heat treatment by using the continuous heat treatment. Examples of control parameters for the electrical heating method include a rate of feeding into the vessel (wire speed), a size of the object to be heated (wire diameter), a current value, and the like. Examples of control parameters for the furnace method include a rate of feeding into the vessel (wire speed), a size of the object to be heated (wire diameter), a furnace size (diameter of a pipe softening furnace), and the like.

<Aging Treatment>

The manufacturing method according to the present invention may further include the step of forming a heat-treated material (aging treated material) by subjecting, to an aging treatment, the solution-heat-treated material (heat-treated material) that has undergone the above-described solution heat treatment. By performing the aging treatment after the solution heat treatment, the added elements in the Al alloy are precipitated, allowing the precipitate to be dispersed in the Al alloy. Strength can be improved by precipitate dispersion hardening, i.e., age hardening, and electrical conductivity can be improved by reducing the dissolved elements. Particularly when the Al alloy has a fine structure as described above, a structure in which the precipitate is uniformly dispersed can be easily formed. This further improves strength, thereby achieving an Al alloy wire having high strength and electrical conductivity.

While the continuous heat treatment described above may be used as the above-described aging treatment, the batch-type heat treatment can also be used, in which case a sufficient heat-treatment time can be maintained, thus allowing precipitate to sufficiently form. In the case of performing the aging treatment by the batch-type heat treatment, specific conditions may, for example, be a heating temperature not lower than 100° C. and a heating time not shorter than 0.5 hour, and preferably, a heating temperature of 100 to 250° C. and a heating time of 1 to 24 hours. The aging treatment may also be performed in the ambient atmosphere or the above-described atmosphere with low oxygen content.

<Covering Step>

The covered electric wire according to the present invention can be manufactured by including the step of preparing the heat-treated material (any of the single wire, stranded wire, and compressed wire) that has undergone the above-described solution heat treatment and, as appropriate, the aging treatment, and forming the above-described insulating cover layer made of an insulating material on an outer circumference of the heat-treated material.

Furthermore, a wire harness can be manufactured by attaching a terminal portion to an end portion of the obtained covered electric wire described above, and binding together a plurality of the covered electric wires each having a terminal portion.

Advantageous Effects of Invention

The Al alloy wire, the Al alloy stranded wire, the covered electric wire, and the wire harness according to the present invention exhibit excellent bending characteristics, strength, and electrically conductive characteristics. The manufacturing method according to the present invention is capable of manufacturing the above-described Al alloy wire or covered electric wire according to the present invention.

DESCRIPTION OF EMBODIMENTS

Figure 1:
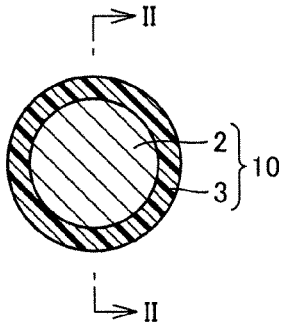
FIG. 1 is a schematic cross-sectional view of a covered electric wire that includes an aluminum alloy wire according to the present invention.

Embodiments of the present invention will be described hereinafter, with reference to the drawings. In the drawings shown below, identical or corresponding parts are denoted by identical reference numbers, and description thereof will not be repeated.

First Embodiment

Figure 2:
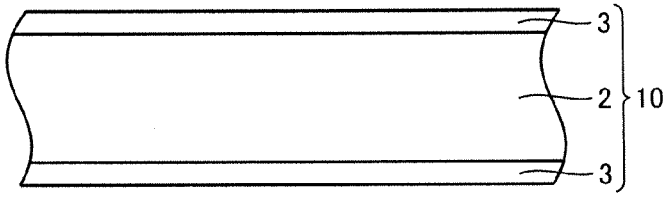
FIG. 2 is a schematic cross-sectional view taken along the line II-II in FIG. 1.

With reference to FIGS. 1 and 2, a covered electric wire that includes an aluminum alloy wire according to the present invention will be described.

As shown in FIGS. 1 and 2, a covered electric wire 10 according to one embodiment of the present invention includes an aluminum alloy wire 2 (hereinafter denoted as Al alloy wire 2) and an insulating cover layer 3 made of an insulating material that covers an outer circumference of Al alloy wire 2. Al alloy wire 2 is composed of an Al—Mg—Si—Cu-based alloy containing 0.1% to 1.5% of Mg, 0.03% to 2.0% of Si, and 0.05% to 0.5% of Cu. Further, in Al alloy wire 2, the mass ratio Mg/Si of Mg to Si satisfies $0.8 \leq Mg/Si \leq 3.5$, the electrical conductivity is not less than 35% IACS and less than 58% IACS, the tensile strength is not less than 150 MPa and not more than 400 MPa, and the elongation is not less than 2%. Al alloy wire 2 according to the present invention contains not less than 0.1% of Mg, not less than 0.03% of Si, and not less than 0.05% of Cu, with these elements being dissolved or precipitated in Al, and thus exhibits excellent bending characteristics and strength. Although the bending characteristics and strength of the Al alloy wire increase as the Mg, Si, and Cu contents improve, the electrical conductivity and toughness decrease, and breakage of the wire tends to occur at the time of, for example, wiredrawing. Therefore, it is preferable to set Mg to not more than 1.5%, Si to not more than 2.0%, and Cu to not more than 0.5%.

Next, a method for manufacturing covered electric wire 10 shown in FIGS. 1 and 2 will be described with reference to FIG. 3.

Figure 3:
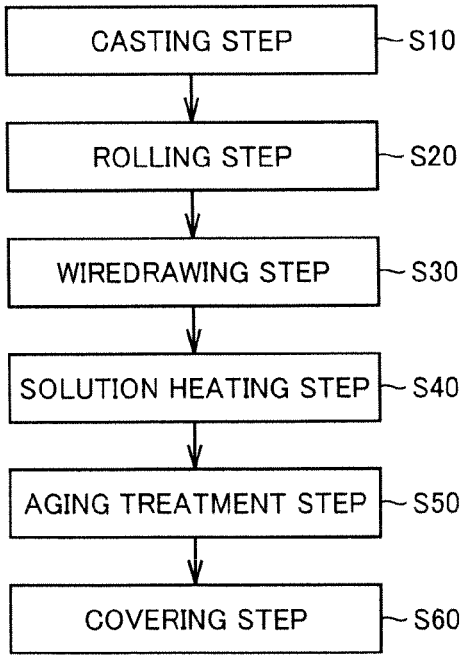
FIG. 3 is a flowchart for illustrating a method for manufacturing the covered electric wire shown in FIGS. 1 and 2.

In the method for manufacturing covered electric wire 10 according to the present invention, a casting step (S10) is performed first, as shown in FIG. 3. Specifically, a cast material made of an Al alloy having the above-described composition is formed. The cast material can be formed by using any of conventionally well-known methods, such as continuous casting that uses a movable mold or a frame-shaped fixed mold, mold casting that uses a box-shaped fixed mold (hereinafter referred to as billet casting), and the like.

Next, a rolling step (S20) is performed, as shown in FIG. 3. In this step (S20), the above-described cast material is (hot) rolled to form a rolled material. Preferably, the above-described casting step (S10) and rolling step (S20) are performed successively.

Next, a wiredrawing step (S30) is performed, as shown in FIG. 3. In this step (S30), the above-described rolled material (or continuously cast and rolled material) is subjected to (cold) wiredrawing to form a wiredrawn material. Any conventionally well-known method can be used as a method of wiredrawing.

Next, a solution heating step (S40) is performed, as shown in FIG. 3. In this step (S40), the above-described wiredrawn material is subjected to a solution heat treatment. For example, the wiredrawn material is heated to not lower than 450° C. in the ambient atmosphere and then rapidly cooled (for example, cooled at a cooling rate not less than 50° C./min), such that the added elements are dissolved into Al, which is the base material of the wiredrawn material, and a supersaturated solid solution is formed.

Next, an aging treatment step (S50) is performed, as shown in FIG. 3. In this step (S50), an aging treatment is conducted, for example, for a heating time not shorter than 0.5 hour at a heating temperature not lower than 100° C.

Next, a covering step (S60) is performed, as shown in FIG. 3. In this step (S60), an insulating cover layer made of an insulating material is formed on the heat-treated material (aging treated material) that has undergone the above-described aging treatment. Any conventionally well-known method can be used as a method of forming the insulating cover layer. In this way, covered electric wire 10 shown in FIGS. 1 and 2 can be obtained.

Second Embodiment

Figure 4:
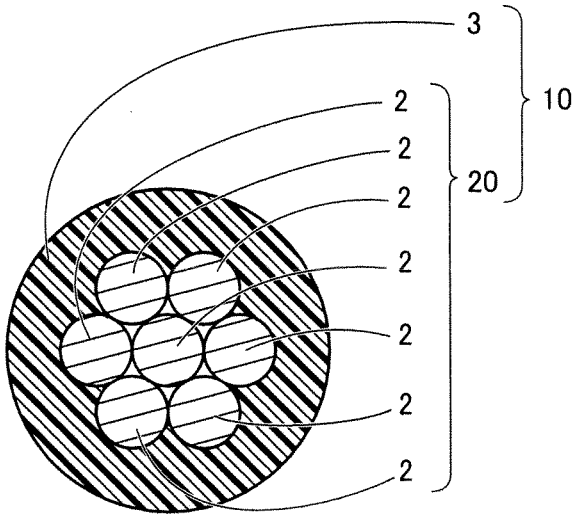
FIG. 4 is a schematic cross-sectional view of a covered electric wire that includes an aluminum alloy stranded wire according to the present invention.

With reference to FIG. 4, a covered electric wire that includes an aluminum alloy wire according to the present invention will be described.

As shown in FIG. 4, covered electric wire 10 according to one embodiment of the present invention includes an aluminum alloy stranded wire 20 formed by stranding together a plurality of Al alloy wires 2 according to the present invention, and an insulating cover layer 3 formed on an outer circumference of aluminum alloy stranded wire 20. In aluminum alloy stranded wire 20, the plurality of Al alloy wires 2 extend along a direction perpendicular to the sheet surface where FIG. 4 is shown and are stranded together. While insulating cover layer 3 is disposed on the outer circumference of aluminum alloy stranded wire 20, insulating cover layer 3 may be formed in intimate contact with an outer circumferential surface of aluminum alloy stranded wire 20, as shown in FIG. 4, or may be formed with a gap being formed between the outer circumferential surface and an inner circumferential surface of insulating cover layer 3. Such covered electric wire 10 can also provide excellent bending characteristics and strength, as with covered electric wire 10 shown in the first embodiment.

As shown in FIG. 4, even in the case of wires having a small diameter (Al alloy wires 2), a wire (stranded wire) having high bending characteristics and strength can be obtained by stranding the wires together. The number of Al alloy wires 2 stranded together is not particularly limited. For example, as shown in FIG. 4, seven Al alloy wires 2 may be stranded together to form aluminum alloy stranded wire 20. The number of Al alloy wires stranded together in aluminum alloy stranded wire 20 may also be 11, 19, or 37. Moreover, after the wires are stranded together, aluminum alloy stranded wire 20 according to the present invention may be compression-molded into a compressed wire, as described below. In this way, the wire diameter can be made smaller than that as stranded, thereby contributing to size reduction in the conductor. While Al alloy wire 2 may have a circular cross-sectional shape as shown in FIG. 4, it may also have any other shape. For example, Al alloy wire 2 may have a polygonal cross-sectional shape (for example, a quadrangular, triangular, or trapezoidal shape). Moreover, while the plurality of Al alloy wires 2 constituting aluminum alloy stranded wire 20 may have the same diameter, Al alloy wires 2 having different diameters may be combined to constitute aluminum alloy stranded wire 20. For example, a centrally positioned Al alloy wire may have a diameter different from that of the other Al alloy wires 2 (positioned around the centrally positioned wire) (for example, the diameter of the centrally positioned Al alloy wire may be increased or decreased relative to that of the others). Further, in aluminum alloy stranded wire 20, Al alloy wires 2 are preferably disposed centrosymmetrically in the cross section shown in FIG. 4, in consideration of the stability of strength and the like.

Figure 5:
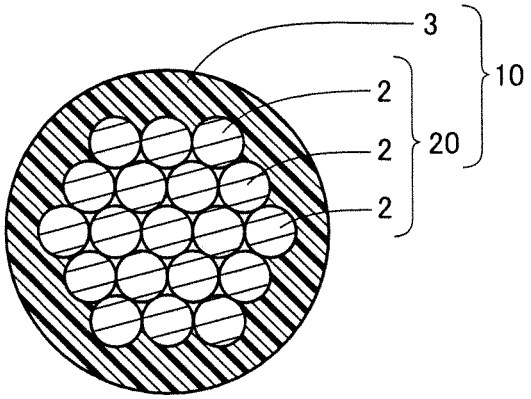
FIG. 5 is a schematic cross-sectional view showing a first modification of the covered electric wire shown in FIG. 4.

Next, with reference to FIG. 5, a first modification of covered electric wire 10 shown in FIG. 4 will be described. With reference to FIG. 5, although covered electric wire 10 basically has the same structure as that of covered electric wire 10 shown in FIG. 4, it differs from covered electric wire 10 shown in FIG. 4 in the number of Al alloy wires 2 constituting aluminum alloy stranded wire 20. That is, aluminum alloy stranded wire 20 constituting covered electric wire 10 shown in FIG. 5 is formed by stranding nineteen Al alloy wires 2 together. Covered electric wire 10 having such a structure can also provide the effects same as those obtained by covered electric wire 10 shown in FIG. 4.

Figure 6:
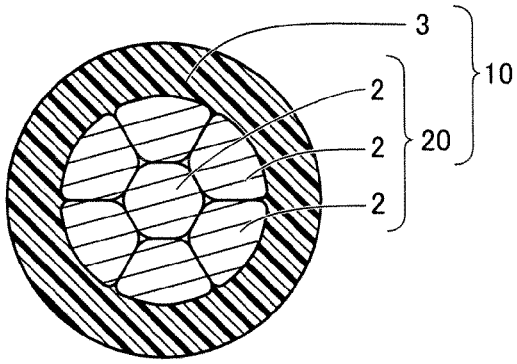
FIG. 6 is a schematic cross-sectional view showing a second modification of the covered electric wire shown in FIG. 4.

Next, with reference to FIG. 6, a second modification of covered electric wire 10 shown in FIG. 4 will be described. With reference to FIG. 6, although covered electric wire 10 basically has the same structure as that of covered electric wire 10 shown in FIG. 4, it differs from covered electric wire 10 shown in FIG. 4 in that aluminum alloy stranded wire 20 is compressed toward the center in a radial direction. Specifically, centrally positioned Al alloy wire 2 in aluminum alloy stranded wire 20 has a substantially hexagonal shape in cross section. Moreover, a plurality of (six in FIG. 6) Al alloy wires 2 disposed around an outer circumference of centrally positioned Al alloy wire 2 have a substantially trapezoidal cross-sectional shape whose length of a side facing the center of aluminum alloy stranded wire 20 is shorter than the length of a side facing an outer circumference thereof. In each of the plurality of Al alloy wires 2 disposed on the outer circumference, a surface positioned facing the outer circumference of aluminum alloy stranded wire 20 (the surface forming the relatively longer side of the trapezoid) is in the form of a curved surface that is convex outward from a central side of aluminum alloy stranded wire 20. Further, a portion where adjacent ones of the plurality of Al alloy wires 2 disposed on the outer periphery are in contact with each other extends substantially linearly, radially outward from the center of aluminum alloy stranded wire 20 in cross section. In this way, in addition to the effects same as those obtained by covered wire material 10 shown in FIG. 4, the wire diameter of covered wire material 10 can be made smaller than that in the case of merely stranding together Al alloy wires 2 having a circular cross section, thereby contributing to size reduction in the conductor. Further, where the diameter of covered wire material 10 is the same, the proportion of the cross sections of Al alloy wires 2 in the cross section of covered wire material 10 can be further increased.

Figure 7:
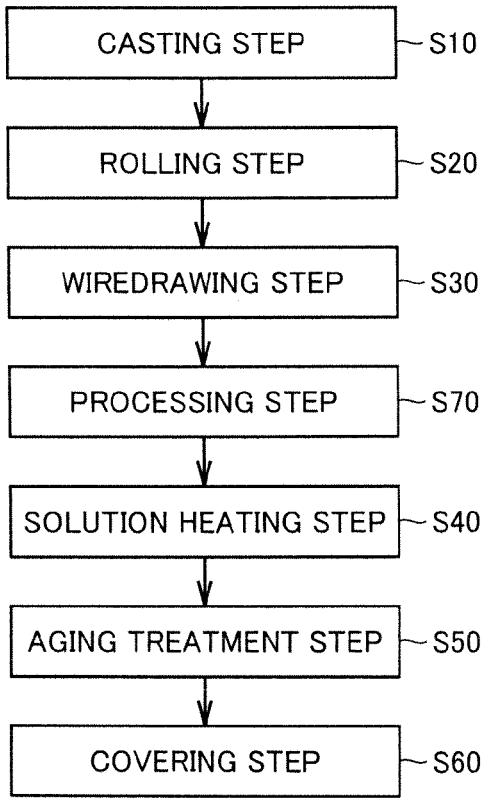
FIG. 7 is a flowchart for illustrating a method for manufacturing the covered electric wire shown in FIG. 4.

Next, with reference to FIG. 7, a method for manufacturing covered electric wire 10 shown in FIG. 4 will be described. With reference to FIG. 7, from the casting step (S10) to the wiredrawing step (S30) in FIG. 7, the same steps as the casting step (S10) to the wiredrawing step (S30) shown in FIG. 3 are performed. A processing step (S70) is subsequently performed, as shown in FIG. 7. Specifically, in this step (S70), the wiredrawn materials obtained in the above-described step (S30) are prepared, and a stranded wire is formed by stranding these wiredrawn materials together. In this way, aluminum alloy stranded wire 20 can be obtained. Further, in one form of the method for manufacturing a covered electric wire according to the present invention, the above-described stranded wire may be compression-molded to form a compressed wire having a predetermined wire diameter.

Next, from the solution heating step (S40) to the covering step (S60) shown in FIG. 7, the same treatments as those from the step (S40) to the step (S60) shown in FIG. 3 are applied to the above-described stranded wire (or compressed wire). In this way, covered electric wire 10 shown in FIG. 4 can be obtained.

Third Embodiment

Figure 8:
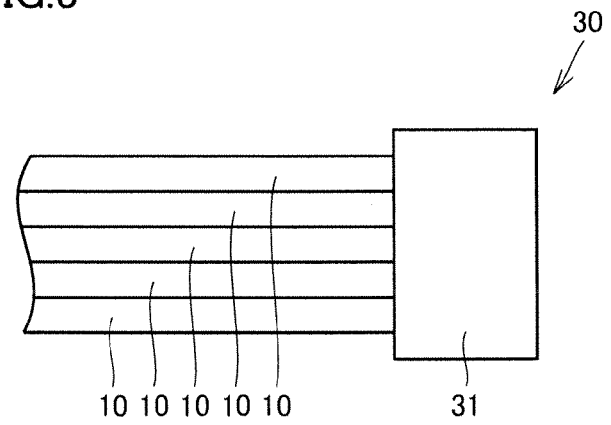
FIG. 8 is a schematic diagram showing a wire harness that includes the covered electric wire according to the present invention.

With reference to FIG. 8, a wire harness according to the present invention will be described.

With reference to FIG. 8, a wire harness 30 in one embodiment of the present invention includes a plurality of covered electric wires 10 according to the present invention and a terminal portion 31 connected to an end portion of each of covered electric wires 10. Terminal portion 31 may be formed by connecting an individual terminal member to the end portion of each individual covered electric wire 10, and subsequently fixing a plurality of the terminal members together. Alternatively, terminal portion 31 may be formed by forming a plurality of connecting portions to which the respective end portions of covered electric wires 10 can be connected. Further, a plurality of wire harnesses 30 as shown in FIG. 8 may be bound together to constitute a larger harness. Sufficient durability can also be achieved in such a wire harness, because of the excellent bending characteristics and strength of covered electric wires 10 according to the present invention.

EXAMPLES

An Al alloy wire was fabricated, and various characteristics of the Al alloy wire were examined. The Al alloy wire is prepared in accordance with the following procedure: melting→continuous casting and rolling→wiredrawing (with an intermediate heat treatment as appropriate)→forming a stranded wire→solution heating (→with an aging treatment as appropriate).

[Characteristics of Al Alloy Wire]

The Al alloy wire is fabricated first. Pure aluminum (Al content: not less than 99.7% by mass) is prepared as a base and melted. To the obtained molten metal (molten aluminum), the additive elements shown in Table 1 are added to give the contents shown in Table 1, thereby fabricating a molten Al alloy. The molten Al alloy in which the components have been adjusted is desirably subjected to, for example, a treatment for removing hydrogen gas and/or a treatment for removing foreign substances, as appropriate.

TABLE 1

| Sample No. | Added Element [Mass %] | | | | | | | |
|---|---|---|---|---|---|---|---|---|
| | Mg | Si | Cu | Fe | Cr | Ti | B | Mg/Si |
| 1 | 0.55 | 0.32 | 0.1 | — | — | 0.02 (200 ppm) | — | 1.7 |
| 2 | 0.2 | 0.25 | 0.1 | — | — | 0.05 (500 ppm) | — | 0.8 |
| 3 | 0.9 | 0.6 | 0.2 | 0.28 | 0.14 | 0.02 (200 ppm) | 0.005 (50 ppm) | 1.5 |
| 4 | 0.9 | 0.6 | 0.2 | — | 0.3 | 0.02 (200 ppm) | 0.005 (50 ppm) | 1.5 |
| 5 | 1.5 | 1 | 0.5 | 0.8 | — | 0.02 (200 ppm) | 0.005 (50 ppm) | 1.5 |
| 101 | 0.05 | 0.01 | 0.01 | — | — | 0.02 (200 ppm) | 0.005 (50 ppm) | 5.0 |
| 102 | 2 | 0.1 | 0.1 | — | — | — | — | 20.0 |
| 103 | 0.9 | 0.6 | 1 | — | — | 0.02 (200 ppm) | 0.005 (50 ppm) | 1.5 |
| 104 | 2.5 | 3 | 0.2 | — | — | 0.02 (200 ppm) | 0.005 (50 ppm) | 0.8 |

A belt-wheel-type continuous casting and rolling machine is used to perform continuous casting and rolling by continuously casting and hot rolling the prepared molten Al alloy, thereby fabricating a wire rod of ϕ 9.5 mm (continuously cast and rolled material). As to a sample containing Ti or containing Ti and B, Ti particles or a $TiB_2$ wire are/is fed to the molten Al alloy immediately before casting, so as to give the content(s) shown in Table 1.

The above-described wire rod is subjected to cold wiredrawing, thereby fabricating a wiredrawn material with a final wire diameter of ϕ 0.3 mm or ϕ 1 mm. A sample indicated with "intermediate heat treatment" in Table 2 is subjected to the intermediate heat treatment (3 hours at 300° C. or under the same conditions as those for the solution heat treatment), as appropriate, in the course of wiredrawing. The obtained wiredrawn material with a final wire diameter of ϕ 0.3 mm or ϕ 1 mm is subjected to a solution heat treatment and, as appropriate, an aging treatment, under the heat treatment conditions shown in Table 2, thereby fabricating a heat-treated material (Al alloy wire).

In the solution heat treatment shown in Table 2, "Electrical Heating" refers to a continuous heat treatment in which heating is performed by resistance heating by directly electrically heating the above-described wiredrawn material, and "Induction Heating" refers to a continuous heat treatment in which the above-described wiredrawn material is heated by high-frequency electromagnetic induction. The batch-type heat treatment using a heating vessel is applied to the samples for which the heating temperatures and heating times are set forth in Table 2. In each of the continuous heat treatments, the above-described correlation data between control parameter values and measured data is created in advance, the control parameters (linear velocity, current value, etc.) are adjusted based on this correlation data so as to obtain desired characteristics (electrical conductivity, etc.), and the heat treatment is applied to each sample. As the aging treatment, the batch-type heat treatment using a heating vessel is applied.

TABLE 2

| Sample No. | Intermediate Heat Treatment | Heat Treatment Conditions: Solution Heating Treatment: Heating Temperature [° C.] | Heating Time [H] | Atmosphere | Aging Treatment: Heating Temperature [° C.] | Heating Time [H] |
|---|---|---|---|---|---|---|
| 1 | No | Electrical Heating | | Ambient Atmosphere | 160 | 8 |
| 2 | No | Induction Heating | | Ar | — | — |
| 3 | Yes | 530 | 3 | Ar | 140 | 8 |
| 4 | Yes | 530 | 1 | Ambient Atmosphere | 120 | 8 |
| 5 | No | 530 | 5 | $N_2$ | 140 | 24 |
| 101 | No | 530 | 3 | Ar | 140 | 12 |
| 102 | No | Electrical Heating | | Ambient Atmosphere | 120 | 5 |
| 103 | No | Electrical Heating | | Ambient Atmosphere | 120 | 5 |
| 104 | No | 530 | 3 | Ar | 100 | 16 |

Tensile strength (MPa), electrical conductivity (% IACS), elongation (%), and bending characteristics were measured for each of the obtained heat-treated materials with a final wire diameter of ϕ 1.0 mm. The results are shown in Table 3.

Tensile strength (MPa) and elongation (%, breaking elongation) were measured in compliance with JIS Z 2241 (tensile testing method for metallic materials, 1998), using a universal tensile test machine. Electrical conductivity (% IACS) was measured by the bridge method.

Figure 9:
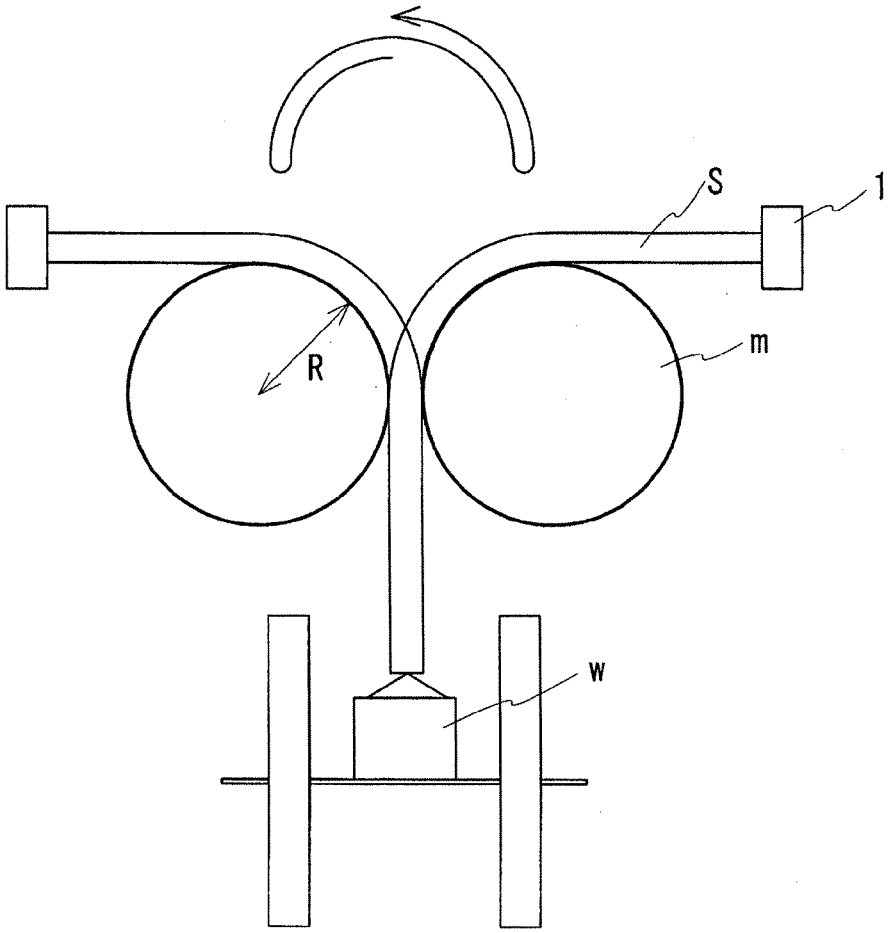
FIG. 9 is an explanatory diagram for illustrating a testing method for examining bending characteristics.

Bending characteristics were measured as follows. As shown in FIG. 9, a sample S (diameter: ϕ 0.3 mm) was placed between a pair of opposed mandrels m. With a weight w (applied load: 100 g) being attached to one end of sample S, and the other end being gripped with a lever 1 of the testing machine, bending with a bending radius R (=15 mm) was applied to sample S along the circumference of mandrels m. The number of times of bending until breakage of sample S was measured. The number of times of bending was counted with bending by 90° and bending back being defined as once. For example, when the sample is bent as indicated by the arrow shown in FIG. 9, the number of times of bending is two.

TABLE 3

| Sample No. | Tensile Strength [MPa] | Electrical Conductivity [% IACS] | Elongation [%] | Bending Characteristics [Times] |
|---|---|---|---|---|
| 1 | 291 | 54 | 3 | 28898 |
| 2 | 246 | 44 | 10 | 28762 |
| 3 | 313 | 42 | 15 | 38596 |
| 4 | 287 | 40 | 18 | 30256 |
| 5 | 305 | 42 | 12 | 35491 |
| 101 | 80 | 61 | 28 | 9543 |
| 102 | 200 | 32 | 30 | 21225 |
| 103 | 330 | 38 | 1 | 40592 |
| 104 | 380 | 30 | 1 | 41275 |

As shown in Table 3, it is observed that an Al alloy wire having excellent bending characteristics can be obtained by performing the solution heat treatment. Samples Nos. 1 to 5, in particular, each composed of an Al—Mg—Si—Cu-based alloy having the specific composition and subjected to the solution heat treatment, exhibited excellent bending characteristics and strength. Each of these samples Nos. 1 to 5 also exhibited a high electrical conductivity and a high elongation, and satisfied the conditions of an electrical conductivity not less than 35% IACS and an elongation not less than 2%. It is particularly observed that samples having a tensile strength not less than about 250 MPa, while having an electrical conductivity not less than 40% IACS and an elongation not less than 10%, were obtained. Furthermore, it is observed that strength and electrical conductivity tend to be improved by performing the aging treatment after the solution heat treatment.

In contrast, it is observed that each of samples Nos. 101 and 102, not composed of an Al—Mg—Si—Cu-based alloy having the specific composition, was inferior in bending characteristics and strength, even though the wiredrawn material with a final wire diameter was subjected to the solution heat treatment and the aging treatment. On the other hand, it is observed that although each of samples Nos. 103 and 104 containing a large amount of Mg or Cu had a high strength and excellent bending resistance, it had a low elongation and also a low electrical conductivity.

As described above, Al alloy wires each composed of an Al—Mg—Si—Cu-based alloy with the specific composition and obtained by subjecting the wiredrawn material with a final wire diameter to the solution heat treatment and, as appropriate, to the aging treatment, are excellent not only in bending characteristics but also in strength, electrically conductive characteristics, and toughness. Accordingly, these Al alloy wires are expected to be suitably used as conductors for electric wires of wire harnesses, particularly as conductors for electric wires of automobile wire harnesses in which light weight is desired.

It is noted that the foregoing embodiments and examples can be modified as appropriate, without departing from the gist of the present invention, and are not limited to the structures described above. For example, the composition of the Al alloy, the wire diameter of the Al alloy wire, the conditions for the solution heat treatment, and the like may be varied within specific ranges. Moreover, the Al alloy wires can be formed into a stranded wire or a compressed wire.

INDUSTRIAL APPLICABILITY

The covered electric wire according to the present invention can be suitably used in applications where light weight as well as excellent bending characteristics and strength are desired, for example, as electric wires of automobile wire harnesses. Each of the aluminum alloy wire and the aluminum alloy stranded wire according to the present invention can be suitably used as a conductor of the above-described covered electric wire. The wire harness according to the present invention can be suitably used in, for example, the wiring of an automobile. Each of the method for manufacturing an aluminum alloy wire according to the present invention and the method for manufacturing a covered electric wire according to the present invention can be suitably used in the manufacturing of the aluminum alloy wire or the covered electric wire according to the present invention described above.

REFERENCE SIGNS LIST

2: aluminum alloy wire, 3: insulating cover layer, 10: covered electric wire, 20: aluminum alloy stranded wire, 30: wire harness, 31: terminal, 1: lever, S: sample, w: weight, m: mandrel, r: bending radius.

The invention claimed is:

1. An aluminum alloy wire used as a conductor, comprising:

not less than 0.2% and not more than 1.5% by mass of Mg, not less than 0.25% and not more than 2.0% of Si, not less than 0.1% and not more than 0.5% of Cu, as essential elements, and a remainder including Al and an impurity, wherein among said essential elements, at least Cu is precipitated in the aluminum alloy, and having a mass ratio Mg/Si of said Mg to said Si satisfying $0.8 \leq Mg/Si \leq 3.5$, an electrical conductivity not less than 35% IACS and less than 58% IACS, a tensile strength not less than 150 MPa and not more than 400 MPa, and an elongation not less than 2%.

2. The aluminum alloy wire according to claim 1, further comprising at least one element of Fe and Cr, wherein Fe content by mass is not less than 0.1% and not more than 1.0%, and Cr content by mass is not less than 0.01% and not more than 0.5%.

3. The aluminum alloy wire according to claim 1, further comprising at least one element of Ti and B, wherein a proportion by mass of Ti is not more than 500 ppm, and a proportion by mass of B is not more than 50 ppm.

4. The aluminum alloy wire according to claim 1, having a wire diameter not less than 0.1 mm and not more than 1.5 mm.

5. An aluminum alloy stranded wire obtained by stranding together a plurality of the aluminum alloy wires according to claim 1.

6. A covered electric wire comprising, as a conductor, any of the aluminum alloy wire according to claim 1, an aluminum alloy stranded wire obtained by stranding together a plurality of the aluminum alloy wires, and a compressed wire obtained by compression-molding said aluminum alloy stranded wire, and comprising an insulating cover layer on an outer circumference of the conductor.

7. A wire harness comprising the covered electric wire according to claim 6 and a terminal portion attached to an end portion of said covered electric wire.

8. The aluminum alloy wire according to claim 1, wherein content of Si is greater than that of Cu or content of Mg is greater than that of Cu.

9. An aluminum alloy wire used as a conductor, comprising:

not less than 0.2% and not more than 1.5% by mass of Mg, not less than 0.25% and not more than 2.0% of Si, not less than 0.1% and not more than 0.5% of Cu, as essential elements, and a remainder consisting of Al and an impurity, wherein among said essential elements, at least Cu is precipitated in the aluminum alloy, and having a mass ratio Mg/Si of said Mg to said Si satisfying $0.8 \leq Mg/Si \leq 3.5$.

* * * * *